US007424916B2

(12) United States Patent
Foster et al.

(10) Patent No.: US 7,424,916 B2
(45) Date of Patent: Sep. 16, 2008

(54) FLAMELESS HOT OILER

(75) Inventors: Robert Joseph Foster, Calgary (CA); Dorothy Foster, Calgary (CA)

(73) Assignee: Leader Energy Services Ltd. (CA)

( * ) Notice: Subject to any disclaimer, the term of this patent is extended or adjusted under 35 U.S.C. 154(b) by 578 days.

(21) Appl. No.: 10/838,104

(22) Filed: May 3, 2004

(65) Prior Publication Data

US 2005/0039906 A1 Feb. 24, 2005

(51) Int. Cl.
*E21B 43/24* (2006.01)

(52) U.S. Cl. ..... 166/303; 166/57; 166/90.1

(58) Field of Classification Search ..... 166/302, 166/57, 90.1, 303
See application file for complete search history.

(56) References Cited

U.S. PATENT DOCUMENTS 4,196,854 A * 4/1980 Prucyk ..... 239/129
4,212,354 A * 7/1980 Guinn ..... 166/303
4,372,386 A * 2/1983 Rhoades et al. ..... 166/300
4,737,115 A 4/1988 Seidler
5,656,136 A 8/1997 Gayaut et al.
5,988,280 A * 11/1999 Crawford et al. ..... 166/303
2005/0082064 A1* 4/2005 Foster et al. ..... 166/303
2005/0224223 A1* 10/2005 Hayes ..... 166/57

FOREIGN PATENT DOCUMENTS

CA 2276048 A1 7/1998

* cited by examiner

*Primary Examiner*—Hoang Dang
(74) *Attorney, Agent, or Firm*—Lerner, David, Littenberg, Krumholz & Mentlik, LLP

(57) ABSTRACT

A flameless heating system comprising: at least one engine, each engine including a coolant for removing heat from the engine and each engine producing exhaust; a loading means for loading the engine; a heat exchange system, the heat exchange system comprising: a heat exchange fluid; a pump for circulating the heat exchange fluid; at least one heat exchanger for transferring heat from the at least one engine coolant to the heat exchange fluid; and an exhaust heat exchanger for transferring heat from the exhaust of the at least one engine to the heat exchange fluid; a batch fluid; and a heat exchanger for transferring heat from the heat exchange system to the batch fluid, wherein heat is transferred from the engine to the heat exchange system, and from the heat exchange system to the batch fluid.

33 Claims, 5 Drawing Sheets

FLAMELESS HOT OILER

FIELD OF THE INVENTION

The present invention relates to a flameless system for use in the servicing of oil and gas wells and more particularly to a flameless hot oiler in which the heat for heating the batch process fluid primarily comes from the engine of the tractor transporting the hot oiler.

BACKGROUND

Production tubing within a well bore requires periodic maintenance to remove paraffin deposits that could restrict production. These deposits are generally the result of changing pressures and temperatures within a production system and the removal of these deposits is accomplished through a technique known as hot oiling in which heated fluids, typically oil, are circulated through the production system. As will be appreciated by those skilled in the art, hot oiling has other applications and the use of the system described and claimed below is not limited to any particular application. Moreover, the term "hot oiler" is itself merely generic, and the below described system can be used to heat different fluids for different applications including, but not limited to water, treatment fluids used for well stimulations and chemicals or virtually any other fluids requiring heating.

Standard hot oilers are diesel fired units that use an open flame to create the heat needed to heat the batch oil. This flame heats pipes that are in direct contact with it as the batch fluid to be heated flows through the pipes for thermodynamic heat exchange. Heating is performed at or close to atmospheric pressure.

Several problems exist, however, with open combustion burners. The use of open flame is less controlled compared to the use of flameless systems. Exhaust gasses are often hotter in an open combustion system and if they are not monitored these systems can flood and expel flame. The temperatures can reach instantaneous temperatures greater than that of the kindling temperatures of natural gas. This means that if there was a natural gas leak, an ignition point is present. A diesel or propane leak in the vicinity of the burner can also be ignited.

Further, the combustion process in open flame systems is not as complete as in closed systems, and free radicals thereby escape into the atmosphere. Closed combustion engines have compression ratios commonly 14 times greater than open combustion burners. This lack of compression negatively affects the reactiveness of oxygen. Hydrocarbon/oxygen reactions are exothermic which provides the heat energy used by the hot oiler. Provided that the combustion is given enough oxygen, heat and time to complete the process, carbon dioxide and water are produced, which are more benign byproducts. However, nitrogen gas is also present during combustion and if the reaction is not ideal, some molecules of nitrogen attach themselves to oxygen to produce the poisonous gas NO. This gas is referred to as a free radical. Incomplete combustion also produces carbon monoxide which also is a pollutant. NO and carbon monoxide are well recognized as being harmful to the environment.

Open flame systems also require more fuel than flameless systems. Fuel is burned less efficiently in these systems, requiring a greater amount of fuel to produce an equivalent amount of heat in a flameless system.

Open flame units moreover are mandated by regulation to be kept at a predetermined safe distance from the wellhead. This presents the disadvantage that more tubing is required to bring the heated fluid to the well bore.

SUMMARY OF THE INVENTION

The present invention seeks to overcome the above disadvantages by providing a flameless heating system in which heat can be taken from the engines on a rig and transferred to the batch fluid. In the present invention heat is transferred from the engines using heat exchangers to transfer heat from the engine coolant to a heat exchange fluid. This heat is then transferred to the batch fluid through another heat exchanger.

The present invention further includes an exhaust heat exchanger to transfer heat from the engine exhaust to the heat exchange fluid. This allows the present invention to recover more heat from the engine. In the present invention the engine is preferably the engine from the truck which supports and transports the oil heater.

To make use of available excess horsepower, water brakes are provided to load the engines, thereby producing more heat from the engine. Further, the shearing of the fluid in the water brake produces heat on its own. The heat exchange fluid is used to load the water brake, and the shearing heat is transferred to the heat exchange fluid which is then used as an additional source of heat for heating the batch fluid.

The water brake of the present invention further provides the advantage that it can run empty when no additional loading of the engine is required. This removes the requirement for the usual gearbox that disengages the water brake, saving weight and costs for the system.

The present invention therefore provides a flameless heating system for a batch fluid comprising at least one engine, each said engine producing hot exhaust gas and including a coolant for removing heat from said engine; a heat exchange system, said heat exchange system comprising a heat transferring fluid; a pump for circulating said heat transferring fluid through said heat exchange system; a first heat exchanger for transferring heat from said engine coolant to said heat transferring fluid; an exhaust heat exchanger for transferring heat from said exhaust gas to said heat transferring fluid; and a second heat exchanger for transferring heat from said heat exchange system to said batch fluid wherein heat is transferred from said engine to said heat exchange system, and from said heat exchange system to said batch fluid.

According to the present invention, there is also provided a flameless heating unit for heating a batch fluid, comprising an internal combustion engine; means for deriving heat from said internal combustion engine and transferring the heat to a heat transferring fluid; a first heat exchanger for transferring said heat from said heat transferring fluid to said batch fluid; means for circulating said heat transferring fluid through said first heat exchanger; means for circulating said batch fluid through said first heat exchanger for heating of said batch fluid; and means for pumping said heated batch fluid for use where required.

According to yet another aspect of the present invention, there is also provided a method for flamelessly heating a batch fluid, said method comprising the steps of extracting heat from an internal combustion engine and transferring the heat to a heat transferring fluid; circulating said heat transferring fluid and said batch fluid through a first heat exchanger for effecting the transfer of heat from said heat transferring fluid to said batch fluid.

BRIEF DESCRIPTION OF THE DRAWINGS

Preferred embodiments of the present invention will now be described in greater detail and will be better understood when read in conjunction with the following drawings, in which.

DETAILED DESCRIPTION OF THE PREFERRED EMBODIMENTS

Figure 1:
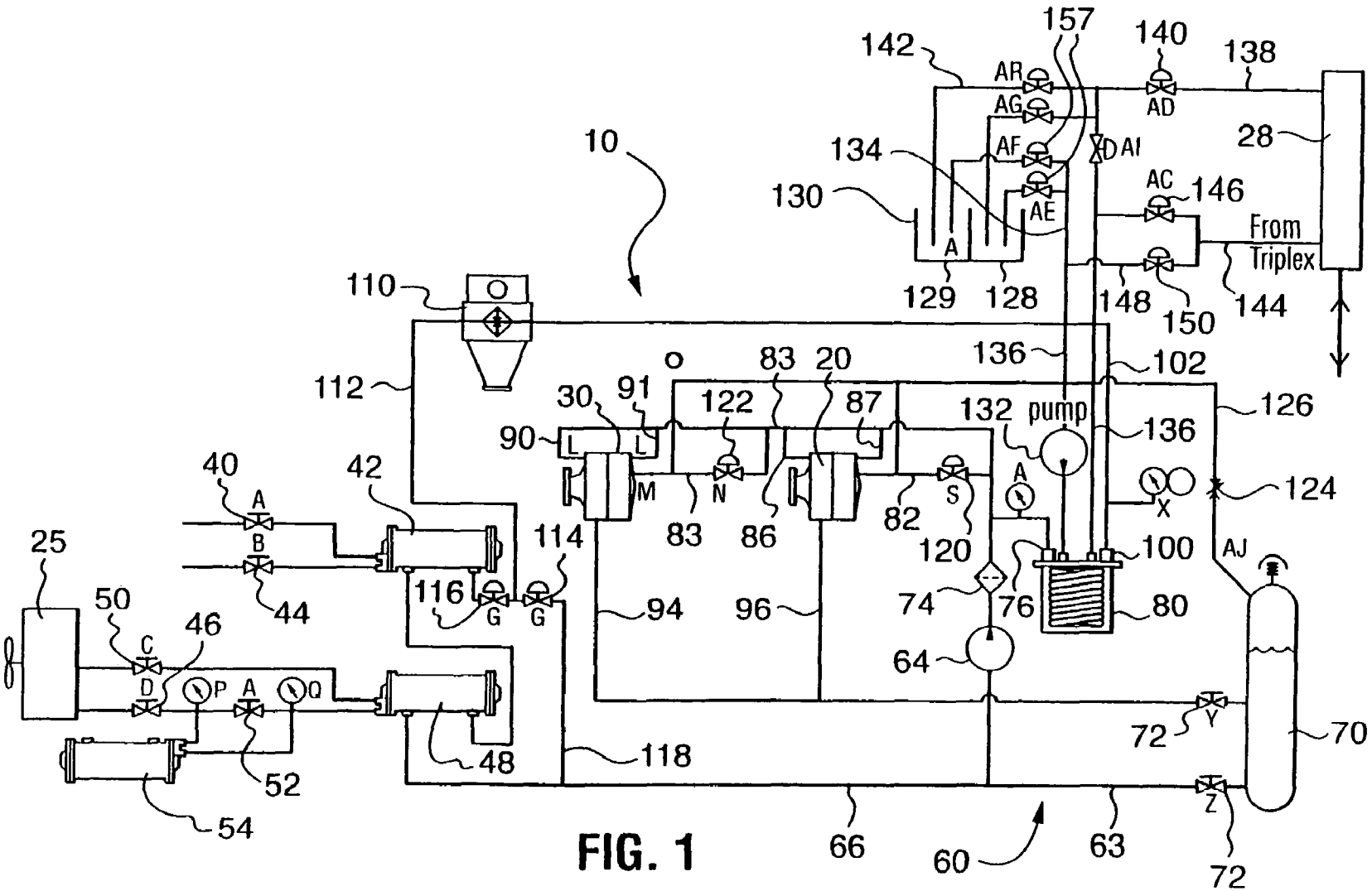
FIG. 1 is a schematic flow diagram of the flameless oil heater.

Reference will now be made to FIG. 1 for a more detailed description of a two-engined hot oiler 10. Flameless hot oiler 10 is preferably capable of producing 5.4 million BTU/hour and captures this heat from three sources: engine water cooling systems; exhaust gases; and the use of excess engine horsepower to provide shear heat in a heat transfer fluid.

A hot oiler 10 capable of producing this amount of heat can have two engines that can be used to produce heat both as a by-product of their internal combustion and by converting available excess horsepower to heat. The truck's in-frame engine is used by the rig and can be mechanically coupled to a water brake 20. A deck engine 25 is mounted to the rig deck and can be mechanically coupled to a deck water brake 30.

Heat from the in-frame engine is transferred to the in-frame engine's water cooling system. These cooling systems are well known in the art, and the fluid used can be water, glycol (anti-freeze) or a combination of the two. Water flows through valve 40 into a heat exchanger such as shell and tube heat exchanger 42 where heat is transferred to a heat exchange fluid. The engine fluid then exits heat exchanger 42 through valve 44. Valves 40 and 44 are located on the engine block and can be used to isolate water flow from heat exchanger 42. Opening valves 40 and 44 allows the engine coolant to circulate through heat exchanger 42.

Similarly, cooling water from deck engine 25 flows through valve 46 into a second heat exchanger such as shell and tube heat exchanger 48 where heat is transferred to the heat exchange fluid. The engine coolant then exits heat exchanger 48 and flows through valve 50. As with the in-frame engine, valves 46 and 50 can be used to isolate water flow from heat exchanger 48.

Heat from the rig's hydraulics can further be transferred to the deck engine coolant by using valve 52. When valve 52 is open, the deck engine coolant flows directly to heat exchanger 48. Closing valve 52 causes the deck engine coolant to flow through a third heat exchanger 54, where heat from the hydraulic fluid that circulates through the present rig's hydraulic equipment is transferred to the deck engine coolant. This heat is then transferred to the heat transfer fluid in heat exchanger 48. Pressure valves 52 and 46 ensure that the pressure within heat exchanger 54 is within operational limits.

Heat from the engines is transferred to a closed heat exchange loop 60 containing the heat exchange or transferring fluid. This heat exchange fluid preferably is capable of exchanging heat at temperatures of 40 to 200 degrees Celsius without breaking down. Such fluids are well known in the art, and one example of such a fluid is Calflow-AF™ from Petro Canada.

Heat exchange loop 60 incorporates a hydraulically actuated pump such as centrifugal pump 64 which may be, for example, a Gould™ 2×3. Pump 64 is connected at its intake end to two sources of heat exchange fluid. The first is supply line 66 which delivers hot fluid from heat exchangers 42 and 48. The second source is supply line 68 that delivers heat exchange fluid from heat exchange fluid tank 70. Valves 72 can be used to isolate tank 70 if required.

Pump 64 forces the heat exchange fluid through a filter 74 following which the flow is split up to four different ways. Part of the heat exchange fluid is deviated into inlet 76 of heat exchanger 80. Another part is divided into feed lines 82 and 83 (eg. 1 inch) that flow into water brakes 20 and 30 respectively. A smaller part is diverted into ¼ inch lines 86, 87, 90 and 91. These small lines fluidly connect with ⅛ inch orifices inside water brakes 20 and 30 that divert heat exchange fluid against the water brakes' seals and/or bearings when the water brakes run empty as will be described below in greater detail.

Water brakes generally are well known in the art and therefore will not be described in great detail herein except with respect to certain modifications that are described below.

To maximize the production of heat from the truck and deck engine cooling systems, it is necessary that these engines be fully loaded. Some of this load will come from parasitic loads such as alternators, water pumps and so forth, and some from the power required for the hot oiler's hydraulic motors and other systems. For example, the deck engine can be used to run the auxiliary hydraulics that actuate centrifugal pumps 64 and 132. The truck's engine can be used for the larger hydraulics for triplex pump 28 (FIG. 2) used to inject and then recover the batch fluid from the well bore. These loads are not sufficient by themselves however to cause the engines to produce their maximum horsepower and heat output. The engines are therefore mechanically coupled to water brakes 20 and 30 to produce the required added load.

The mechanical coupling between the engines and water brakes 20 and 30 is conventional and numerous means of coupling them operationally together will occur to those skilled in the art. For example, as is known in the art, the truck's gearbox (not shown) will have one or more auxiliary power take-offs. One of these take-offs can be used to drive the rig's hydraulics and the other can be mechanically coupled to water brake 20 such as by means of shaft, belt or chain. Or the engine's power take-off can be drivingly coupled to a gearbox having for example two outlets. One outlet can be directly coupled to the water brake and the other to the rig's hydraulic motors which in turn drive the various pumps referred to above.

Generally, water brakes comprise a sealed chamber that is normally kept full of heat transfer fluid. A plurality of radially extending, shaft mounted blades, impellers or rotor/stators are disposed to rotate within the chamber against the shear resistance of the heat transfer fluid. The shaft is rotated by the motor being loaded through a mechanical coupling. The mechanical energy from the spinning rotors is converted to heat energy in the heat transfer fluid which is continuously circulated through the chamber to cool the water brake and its seals and to produce heated heat transfer fluid for circulation through heat exchanger 80.

Heat exchange fluid entering water brakes 20 and 30 drains through lines 94 and 96 back into tank 70.

In heat exchanger 80 heat is transferred to the batch fluid, such as hot oil, as described below, and the heat exchange fluid exits heat exchanger 80 through outlet 100 into line 102. The heat exchange fluid next flows through exhaust heat exchanger 110.

Exhaust heat exchanger 110 includes a full flow of heat exchange fluid running through it at all times that pump 64 is operating. Exhaust gases are diverted from both the engines through exhaust heat exchanger 110 when the system is heating oil. When exhaust passes through exhaust heat exchanger 110, it passes over fins with large surface areas. The heat that is collected on the fins is transferred to the heat exchange fluid.

Heat exchange fluid leaves exhaust heat exchanger 110 and travels along line 112. Valves 114 and 116 determine whether the heat exchange fluid then passes through heat exchangers 42 and 48. If valve 114 is open and valve 116 is closed, heat exchange fluid is forced through bypass line 118 into line 66. Otherwise, if valve 116 is open and valve 114 is closed the heat exchange fluid travels through heat exchangers 42 and 44. These heat exchangers transfer heat from the two engine coolants into the heat exchange fluid.

One skilled in the art will realize that a temperature gradient is needed to exchange heat from the engines to the oil being heated. If, for example, it takes 30 degrees Fahrenheit difference to exchange the heat from the engine coolant to the heat exchange fluid, and it takes 30 degrees Fahrenheit difference to exchange the heat from the heat exchange fluid to the oil, then the engine temperature needs to be 60 degrees F. above the product temperature in the hot oiler tank. In this example, the engine coolant contribution to heating the product in the hot oiler tanks drops off exponentially once the temperature between the engine coolant and the liquid in the hot oiler tanks has reached a differential of 60 degrees F. with the coolant being the hotter fluid. Also, the engine coolant should be isolated from the heat exchange fluid when there is a 30 degree F. differential between the coolant and the product in the fluid and the hot oiler tank. After that point, the heat transfer fluid starts to transfer heat to the engine coolant and is transferred to the atmosphere via the radiator. When the heat exchange fluid reaches a temperature approaching that of the engine coolant, valve 116 is closed and valve 114 is opened, isolating the engine coolant from the heat exchange fluid.

As indicated above, water brakes 20 and 30 can at times be allowed to run empty. This occurs if no additional load is required on the engine. In conventional systems the gearboxes splitting power to the water brake would be adapted to disengage the brakes from the engines. These gearboxes however are heavy and expensive. To avoid this, the present water brake in a preferred embodiment of the present invention has been adapted to run empty which otherwise would normally cause the brake and its seals to burn out.

In the present system, each brake's aluminum housing is hardened to 85 Rockwell, and supply lines 86 and 87 for water brake 20 and lines 90 and 91 for water brake 30 continuously deliver a small amount of heat exchange fluid to the ⅛ inch orifices which internally direct the heat exchange fluid against the seals and/or bearings. When valves 120 and 122 are closed to stop the delivery of heat exchange fluid to water brakes 20 and 30 respectively, pressurized air (7 to 10 psi) from heat exchange fluid tank 70 flows through orifice 124 and through air hose 126 into lines 82 and 88 to purge heat exchange fluid from water brakes 20 and 30. Orifice 124 allows air to flow freely but slows down the flow of heat exchange fluid into tank 70 when valves 120 and 122 are open during normal operation. Without the heat exchange fluid in them, water brakes 20 and 30 simply spin without loading the engines. The additional hardening of the water brake's housing and the continuous flow of heat exchange fluid against the seals prevents erosion and pitting of the brake's inner walls and burnout, respectively. Such a water brake provides additional advantages over conventional systems where water brakes could not be run empty.

An additional advantage of the water brakes is that they provide shear heat. Fluid entering through lines 82 and 83 is forced to shear by the rotation of water brakes 20 and 30.

The oil or fluid required to be heated is stored in batch tank 130. A pump such as a Viking pump 132 is used to pump fluid through line 134 into heat exchanger 80. The fluid is heated from the heat exchange fluid and leaves heat exchanger 80 through line 136. The fluid can then be directed to the well through line 138 and Triplex pump 28 if valve 140 is open, or back to batch tank 130 through line 142.

The fluid returns to the hot oiler from the well through line 144, and can either be directed back into the well or to the batch tank if valve 146 is open, or flow back through heat exchanger 80 through line 148 if valve 150 is open.

The present system therefore derives heat from two engine coolants, the exhaust from these engines, and from shear heat generators for heating the heat transferring fluid, which in turn provides heat to the oil or fluid being used for servicing the well. The inventors have found that a 500 hp engine rejects about 800,000 BTU/hr under full load to its water system. Further, this 500 hp engine rejects up to 4 million BTU/hr from the exhaust system. By adding a shearing system, an additional 2,500 BTU/hr is generated for each horsepower of load on an engine.

Figure 2:
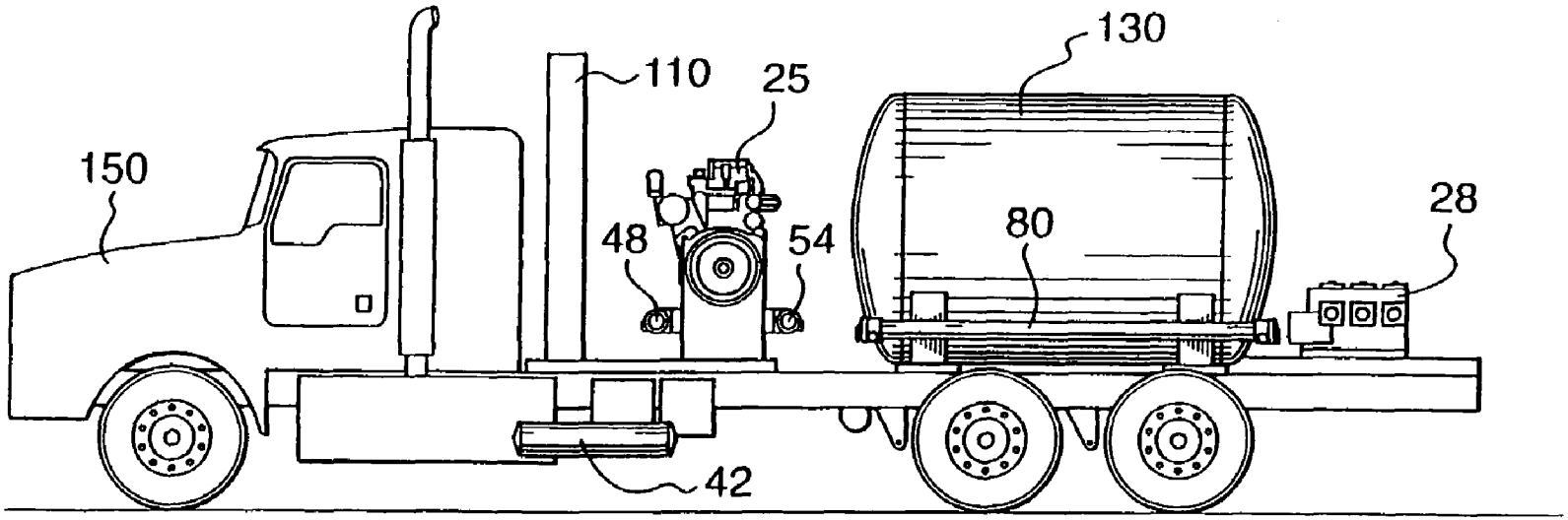
FIG. 2 is a side elevational partially schematical view of the flameless oil heater of FIG. 1.

Reference is now made to FIG. 2. All of the above described elements are located on a truck 150. Truck 150 includes a cab, behind which is exhaust heat exchanger 110. Located rearward of this on truck 150 is deck engine 25. Batch tank 130 is located rearwardly of the deck engine. Triplex pump 28 regulates the flow of the oil to and from batch tank 130 for injection into and recovery from the well. Most of the remaining components described above have been removed for clarity.

It will be appreciated that for smaller hot oilers requiring less heat, deck engine 25 can be eliminated.

Figure 3:
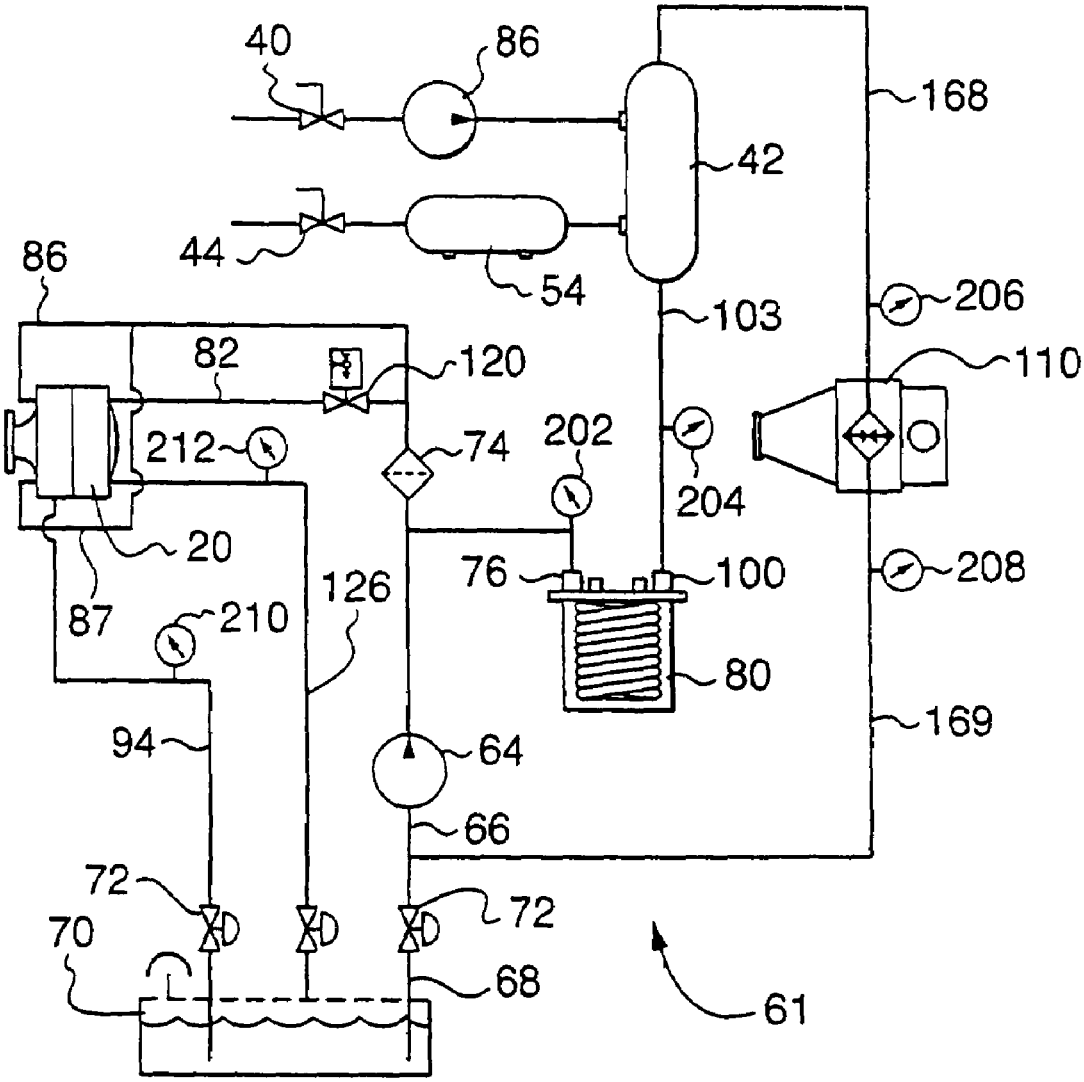
FIG. 3 is a schematic flow diagram of a single engine version of the flameless oil heater.

Reference is made to FIG. 3 which is a flow diagram for a modified closed loop heat exchange system 61 for a single engined flameless hot oiler in which like numerals have been used to identify like elements.

Heat from the truck engine's (not shown) cooling system is captured by heat exchanger 42 with the flow of engine coolant through the exchanger being controlled by valves 40 and 44. In this embodiment, flow can be boosted by the addition of a circulation pump 86 (eg. from Price™). Heat from the rig's hydraulic fluid can be transferred to the truck engine's coolant by means of heat exchanger 54. Not shown are valves which can be used to control the flow of hot hydraulic fluid into exchanger 54 depending upon whether or not this heat source is to be exploited.

Heat transfer fluid from exchanger 42 flows through line 168 into exhaust heat exchanger 110. Heat transfer fluid discharged from exhaust heat exchanger 110 flows through line 169 and then into line 66 which is in fluid communication with the inlet to centrifugal pump 64 which circulates the heat exchange fluid through closed loop 61. This is the first source of heat exchange fluid for pump 64. The second source is supply line 68 that delivers heat exchange fluid from heat exchange fluid tank 70. Valves 72 can be used to isolate tank 70 if required.

As with the two engined version of the hot oiler described above, pump 64 forces the heat exchange fluid through a filter 74 but the flow is split only three different ways. Part of the heat exchange fluid is diverted into inlet 76 of heat exchanger 80. Another part is diverted into feed line 82 that flows into water brake 20. A smaller part is diverted into ¼ inch lines 86 and 87 which deliver a continuous stream of fluid to ⅛ inch orifices inside the break that direct the fluid against the brake's seals and/or bearings when the brake is run empty as described above.

Heated exchange fluid discharged from brake 20 flows through line 94 into reservoir 70.

Valve 120 controls the flow of heat exchange fluid into water brake 20.

When running under load, temperatures in water brake 20 can be extremely high and particularly if the brake is less than full, vapour pressures can rise to the point of possibly jeopardizing the brake's seals. To minimize this possible risk, brake 20 is provided with an unrestricted anti-boil line 126. In operation, valve 72 in line 94 is stoppered down until a small amount of fluid is observed to be discharged from line 126. This is taken as an indication that brake 20 is running full of fluid. Valve 72 can then be left more or less permanently in this position.

When valve 120 is closed, negative pressure develops in the brake which draws air from the space above the fluid level in reservoir 70 through line 126 into the brake which allows it to drain thoroughly. The operation of the brake when empty is then the same as described above with respect to the embodiment of FIG. 1.

As described above, heat exchanger 80 is used to transfer heat to the batch fluid. The heat exchange fluid exits exchanger 80 through outlet 100 into line 103 to complete the flow loop back into engine heat exchanger 42.

The means for circulating the batch fluid through heat exchanger 80 are the same as described above with respect to FIG. 1.

Figure 5:
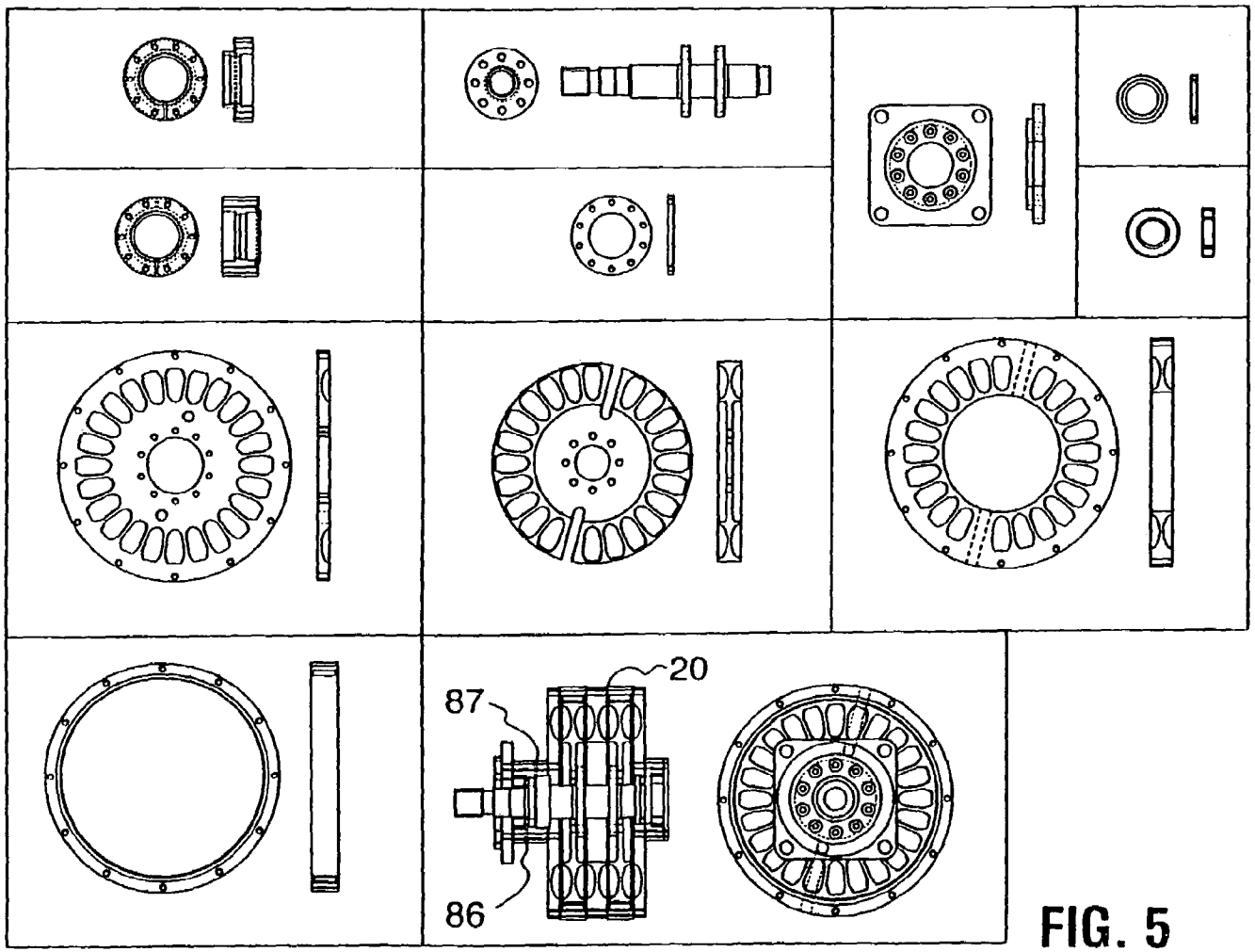
FIG. 5 is a pictorial representation of a water brake forming part of the present rig.

Loop 61 can be provided with various pressure sensors connected to dials or gauges that can be mounted onto a control panel 200 (shown covered) in FIG. 5. The sensors can include sensor 202 for system pressure, 204 for engine heat exchanger inlet pressure, 206 for exhaust heat exchanger inlet pressure, 208 for exhaust heat exchanger outlet pressure, 210 for water brake outlet pressure and 212 for an anti-boil return outlet pressure in flow line 126. This system can also be equipped with temperature sensors for the temperature of the heat exchange fluid, hydraulic fluid, the batch fluid and the engine coolant. There will also be temperature and pressure sensors and gauges for triplex pump 28 used to pump the batch fluid into and from the well.

Figure 4:
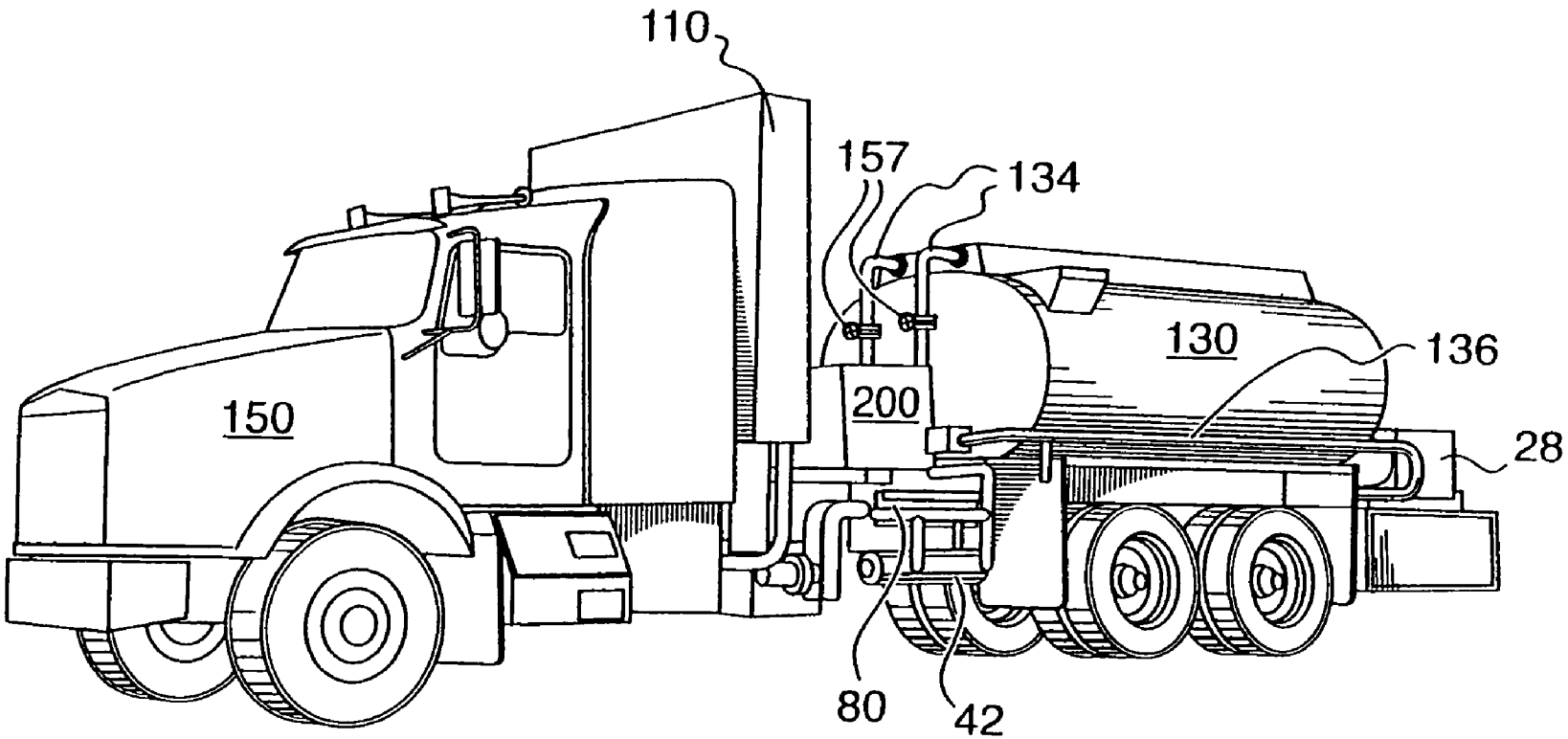
FIG. 4 is a perspective view of the flameless oil heater of FIG. 3.

In one embodiment constructed by the applicant, batch tank 130 can be subdivided as shown in FIG. 1 to include a principal reservoir 129 for batch fluid and a smaller reservoir 128 which can be used as a spare tank for additional batch fluid or for a second batch fluid such as methanol or water. In FIGS. 1 and 4, it can be seen that there are two batch fluid supply lines 134 each with its own valve 157 for selecting the appropriate reservoir. The tank can be further subdivided to include a third chamber for the truck's fuel supply.

The present rig can be optionally provided with additional bolt-on pumps that can be used to draw batch fluid from an external reservoir or even from a low lying source such as a pond or river.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following claims.

We claim:

1. A flameless heating system for a batch fluid comprising:

at least one engine producing hot exhaust gas and including a coolant for removing heat from said engine;

a heat exchange system, said heat exchange system comprising:

a heat transferring fluid;

a pump for circulating said heat transferring fluid through said heat exchange system;

a first heat exchanger for transferring heat from said engine coolant to said heat transferring fluid;

an exhaust heat exchanger for transferring heat from said exhaust gas to said heat transferring fluid; and a second heat exchanger for transferring heat from said heat exchange system to said batch fluid; and means for loading said engine to increase its production of heat, said means for loading comprising a water brake drivingly connected to said engine;

wherein heat is transferred from said engine to said heat exchange system, and from said heat exchange system to said batch fluid.

2. The flameless heating system of claim 1, wherein at least a portion of said heat transferring fluid is circulated through said water brake for the transfer of heat to said fluid, said water brake having a first inlet for said heat transferring fluid and an outlet for the discharge thereof.

3. The flameless heating system of claim 2, additionally comprising a first reservoir having an inlet for receiving said heat transferring fluid from said outlet of said water brake and an outlet for the discharge of said heat transferring fluid to said an inlet of said second heat exchanger.

4. The flameless heating system of claim 3, wherein said pump has an intake in fluid communication with said outlet of said first reservoir and a discharge in fluid communication with said inlet to said second heat exchanger and said first inlet of said water brake.

5. The flameless heating system of claim 4, wherein said water brake includes one or more secondary inlets in fluid communication with said discharge of said pump, and sized for the delivery of a reduced amount of heat transferring fluid into said water brake.

6. The flameless heating system of claim 5, including valve means disposed between said pump and said first inlet of said water brake, said valve being operable to control the flow of said heat transferring fluid through said first inlet of said water brake.

7. The flameless heating system of claim 6, wherein, when said valve means are closed, heat transferring fluid continues to be discharged in a reduced amount into said water brake through said secondary inlets for cooling and lubrication.

8. The flameless heating system of claim 7, wherein said heat transferring fluid flowing through said secondary inlets is directed at seals and/or bearings in said water brake.

9. The flameless heating system of claim 8, including an air line for delivering pressurized air into said first inlet of said water brake when said valve means are closed, wherein said pressurized air forces said heat transferring fluid from said water brake to substantially empty the same.

10. The flameless heating system of claim 9, wherein said substantially empty water brake imposes reduced or no loading on said engine without being drivingly disconnected therefrom.

11. The flameless heating system of claim 10, wherein said pressurized air is obtained from an air space in said first reservoir above said heat transferring fluid therein.

12. The flameless heating system of claim 11, wherein said airline includes restrictor means therein permitting the flow of said pressurized air into said water brake but limiting the flow of heat transferring fluid from said water brake into said first reservoir.

13. The flameless heating system of claim 4, wherein said first heat exchanger has first and second inlets and first and second outlets, said first inlet being in fluid communication with said engine to receive heated coolant therefrom, said first outlet being in fluid communication with said internal combustion engine for the return of said coolant thereto, and said second inlet and outlet being in fluid communication with said heat exchange system for the circulation of said heat transferring fluid therethrough.

14. The flameless heating system of claim 13, including a second pump for pumping said batch fluid through said second heat exchanger.

15. The flameless heating system of claim 14, including a tank for said batch fluid.

16. The flameless heating system of claim 15, including a third pump disposed in fluid communication with an outlet from said second heat exchanger for pumping said heated batch fluid under pressure.

17. The flameless heating system of claim 16, wherein said tank for said batch fluid is subdivided into two or more chambers for the same or different batch fluids.

18. The flameless heating system of claim 17, wherein said first, second and third pumps are hydraulically actuated.

19. The flameless heating system of claim 18, including one or more hydraulic motors for actuation of said first, second and third pumps.

20. The flameless heating system of claim 19, wherein said one or more hydraulic motors are drivingly connected to said engine.

21. The flameless heating system of claim 20, including a third heat exchanger for transferring heat from hydraulic fluid circulating through said first, second and third pumps to said heat transferring fluid.

22. The flameless heating system of claim 1, wherein said system is supported on a ground vehicle.

23. The flameless heating system of claim 22, wherein said engine is the engine of said ground vehicle.

24. The flameless heating system of claim 23, additionally comprising a second engine.

25. The flameless heating system of claim 24, additionally comprising a second water brake drivingly connected to said second engine.

26. The flameless heating system of claim 25, wherein heat from said second engine's exhaust and coolant is transferrable to said heat transferring fluid and wherein at least a portion of said heat transferring fluid is circulated through said second water brake for the transfer of heat to said fluid, said second water brake having a first inlet for said heat transferring fluid and an outlet for the discharge thereof into said first reservoir.

27. A flameless heating unit for heating a batch fluid, comprising:

an internal combustion engine;

means for deriving heat from said internal combustion engine and transferring the heat to a heat transferring fluid, said means comprising a first heat exchanger for transferring heat from said internal combustion engine's coolant to said heat transferring fluid and a second heat exchanger for transferring heat from said internal combustion engine's exhaust gas to said transferring fluid;

a third heat exchanger for transferring said heat from said heat transferring fluid to said batch fluid;

means for circulating said heat transferring fluid through said third heat exchanger;

means for circulating said batch fluid through said third heat exchanger for heating of said batch fluid;

means for loading said internal combustion engine to increase its output of heat, said means for loading comprising a water brake operatively connected to said internal combustion engine; and means for pumping said heated batch fluid for use where required.

28. The flameless heating unit of claim 27, wherein at least a portion of said heat transferring fluid is circulated through said water brake for the transfer of heat to said fluid, said water brake having a first inlet for said heat transferring fluid and an outlet for the discharge thereof.

29. The flameless heating unit of claim 28, additionally comprising a first reservoir having an inlet for receiving said heat transferring fluid from said outlet of said water brake and an outlet for the discharge of said heat transferring fluid to said means for circulating said heat transferring fluid through said first heat exchanger.

30. The flameless heating unit of claim 29, wherein said means for circulating is a pump.

31. The flameless heating unit of claim 30, wherein said pump has an intake in fluid communication with said first reservoir and a discharge in fluid communication with an inlet to said first heat exchanger and said first inlet to said water brake.

32. The flameless heating unit of claim 31, wherein said intake is additionally in fluid communication with said second and third heat exchangers for the intake of heat transferring fluid therefrom.

33. A method for flamelessly heating a batch fluid, said method comprising the steps of:

drivingly connecting an internal combustion engine to a water brake for loading said engine to increase its production of heat;

extracting said heat from a said internal combustion engine and transferring the heat to a heat transferring fluid;

circulating said heat transferring fluid and said batch fluid through a first heat exchanger for effecting the transfer of heat from said heat transferring fluid to said batch fluid for the heating thereof.

* * * * *

UNITED STATES PATENT AND TRADEMARK OFFICE

CERTIFICATE OF CORRECTION

PATENT NO. : 7,424,916 B2
APPLICATION NO. : 10/838104
DATED : September 16, 2008
INVENTOR(S) : Foster et al.

It is certified that error appears in the above-identified patent and that said Letters Patent is hereby corrected as shown below:

Title Page, After "Prior Publication Data US 2005/0039906 A1 February 24, 2005"

Insert --(30) Foreign Application Priority Date

May 1, 2003 (CA) .....2,427,410--.

Col. 4, Line 48 replace ". Or" after chain with --, or--.

Col. 10, Line 51 delete "a" before "said internal combustion engine".

Signed and Sealed this

Twenty-second Day of December, 2009

David J. Kappos

David J. Kappos
*Director of the United States Patent and Trademark Office*